United States Patent [19]

Kazuyuki et al.

[11] Patent Number: 4,643,470

[45] Date of Patent: Feb. 17, 1987

[54] LOCKING DEVICE OF OPENING AND CLOSING MEMBERS FOR VEHICLES

[75] Inventors: Ishii Kazuyuki, Shiki; Ebe Yoshio; Fujieda Shuji, both of Tokyo, all of Japan

[73] Assignees: Honda Giken Kogyo Kabushiki Kaisha; Kabushiki Kaisha Toyosha Seisakusho, both of Tokyo, Japan

[21] Appl. No.: 767,610

[22] Filed: Aug. 20, 1985

[30] Foreign Application Priority Data

Sep. 8, 1984 [JP] Japan ..... 59-136545[U]

[51] Int. Cl.[4] ..... E05C 3/26

[52] U.S. Cl. ..... 292/216; 292/DIG. 73

[58] Field of Search ..... 292/216, 44, 45, 50, 292/52, 53, 11, 25, 341.12, 341.13, DIG. 53, DIG. 73

[56] References Cited

U.S. PATENT DOCUMENTS

| | | | |
|---|---|---|---|
| 3,367,699 | 2/1968 | Leslie | 292/216 |
| 3,371,948 | 3/1968 | Velavicius . | |
| 3,380,771 | 4/1968 | Rogers | 292/216 X |
| 3,439,948 | 4/1969 | Smith | 292/216 |
| 3,545,800 | 12/1970 | Arlauskas | 292/216 |
| 3,917,330 | 11/1975 | Quantz | 292/216 |
| 4,478,441 | 10/1984 | Fiordellisi et al. | 292/216 |
| 4,545,606 | 10/1985 | Vodra | 292/216 X |

FOREIGN PATENT DOCUMENTS

| | | | |
|---|---|---|---|
| 2544781 | 11/1984 | France | 292/216 |

*Primary Examiner*—Robert L. Wolfe
*Assistant Examiner*—Russell W. Illich
*Attorney, Agent, or Firm*—Holman & Stern

[57] ABSTRACT

A locking device for locking a closure member of a vehicle including a pivotal locking member having a slot for receiving a rod-like engaging member with a slight spacing between the slot and engaging member. A jackplate is provided which is pivoted coaxially with the locking member and is urged by a spring toward the engaging member thereby absorbing any play produced due to the slight spacing between the engaging member and locking member. This locking arrangement absorbs any vibrations applied to the locking device which may cause rattling sounds.

3 Claims, 4 Drawing Figures

LOCKING DEVICE OF OPENING AND CLOSING MEMBERS FOR VEHICLES

BACKGROUND OF THE INVENTION

This invention relates to a device for locking opening and closing members such as engine hoods, trunk lids and the like for automobiles.

PRIOR ART TECHNIQUES

In the device of this type, a slight spacing is required in the locked state of the device in order to smoothly perform the engagement and disengagement of the rod-like engaging member called a striker and the fork-like locking member for engaging it. Accordingly, there may arise a problem that when vibrations are applied to the device under the condition of the device being engaged, unusual sounds may be produced due to the striking or collision of the engaging member and the locking member against each other

OBJECT OF THE INVENTION

This invention is to solve the above-mentioned problem and its object is to provide a locking device of opening and closing members for vehicles wherein no unusual sound may be produced from the locking device construction due to any vibrations applied thereto and the positioning of the members for absorbing any play between the engaging member and the locking member is easily attained.

SUMMARY OF THE INVENTION

This invention is intended to provide a locking device of opening and closing members for vehicles wherein the locking member which is fixed with a slight spacing to the rod-like engaging member provided on the opening and closing member or on the vehicle body is pivotably mounted on a bracket 3 provided on the vehicle body or on the opening and closing member, and wherein a jackplate which is to be engaged with the afore-mentioned engaging member at an engaging position of the locking member is pivoted coaxially with the locking member whereby the plate is urged by a spring toward the rod-like engaging member together with the locking member, thereby enabling to absorb any play produced due to a slight spacing between the engaging member and the locking member.

EFFECTIVENESS OF THE INVENTION

According to the present invention, when the engaging member provided on the opening and closing member or on the vehicle body is locked by the locking member provided on the vehicle body or on the side of the opening and closing member, the engaging member can be pressed by the jackplate substantially from the opposite direction of the direction of engagement, and the jackplate is provided overlappingly with the locking member to be urged together by the same spring so that the engaging member may be pressed within the range of necessity by adjusting the amount of projection of the plate from the locking member whereby the intended object may surely be attained.

BRIEF DESCRIPTION OF THE DRAWING

The drawings show a locking device of opening and closing members for vehicles according to this invention, wherein.

EXAMPLE OF EMBODIMENT

The invention will now be described in more detail hereunder.

Figure 1:
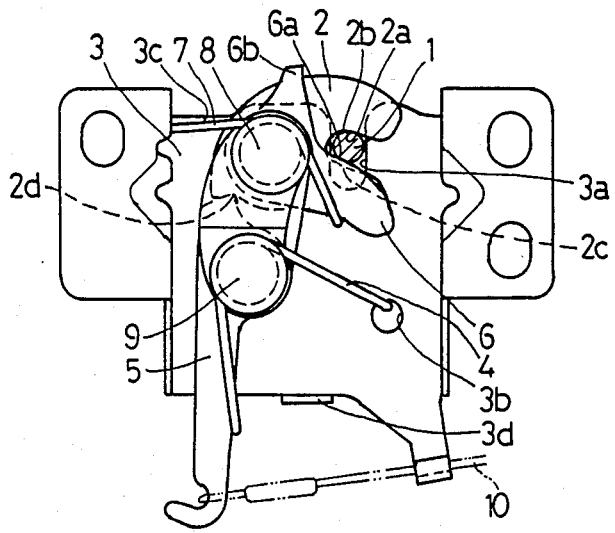
FIG. 1 is a front view of a first embodiment.
Figure 2:
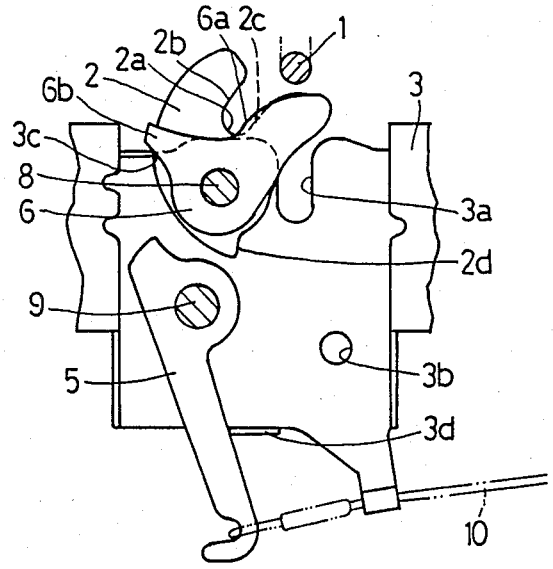
FIG. 2 is a view illustrating the operation thereof.

FIGS. 1 and 2 relate to an example according to the first embodiment, wherein the reference numeral 1 is a striker or engaging member provided on the side of the opening and closing member; 2 is a U-shaped engaging cam or locking member having a slot 2*a* for engaging with the striker 1 and is pivotably mounted by the pivot 8 on the bracket 3 secured to the side of the vehicle. 2*b* is an engaging edge of the cam 2; 2*c* is a leading portion opposed thereto by means of the slot 2*a;* 2*d* is a cam portion; and 3*a* is a striker admission slot provided on the bracket 3. 4 is a spring one end of which is engaged with a small hole 3*b* formed in the bracket 3; 5 is an engaging member designed to engage with the cam portion 2*d* of the cam 2 at the engaging position, and one end of the spring 7 for urging the cam 2 is engaged with the cam 2 as well as the jackplate 6 which is to be described later and the other end thereof is engaged with the bracket 3, the direction of urging being the unlocking direction for the cam 2. 9 is a pivot mounting the cam 5 on the bracket 3, and 10 is a wire for operating the cam 5 in the direction for disengaging the same.

And 6 is the jackplate pivoted coaxially with the cam 2, one side of the jackplate having a slant edge 6*a* projecting from the leading portion 2*c* and of substantial gradient, and the spring 7 is engaged in common with the cam 2 and the curved lower edge of the jackplate 6 against the striker 1 which is to be depressed downwardly by the engaging edge 2*b* so that the plate may be pressed slantly upwardly under the action of this spring 7. Part 6*b* is the pivotable projection of the jackplate 6 which is pivotably urged integrally with the cam by the spring 7 which has urged the cam in the direction of unlocking, the projection being designed to be stopped by means of the abutting member 3*c* provided in the bracket 3. 3*d* indicates the stopper defining the pivotable range of the engaging member 5.

In the construction described above, when the striker 1 is lowered by the operation of the opening and closing member toward the striker admission slot 3*a* of the bracket 3 (FIG. 2), it enters the locking plate, that is, the U-shaped slot 2*a* of the cam 2 which is being in the receiving state urged by the spring 7 in the unlocking direction, and it comes to be overlapped on the leading portion 2*c* to strike the slant edge 6*a* projecting more than it to rotate the cam 2 together with the jackplate 6, thereby the engaging member 5 is pivoted to cause its foremost end to engage with the cam portion 2*d* of the cam 2, whereby the striker 1 is locked (FIG. 1), but against the depression of the striker 1 by the engaging edge 2*b* of the cam the striker 1 is pressed from the opposing direction by the slant edge 6*a* of the jackplate 6 so that the jackplate 6 may somewhat retreat due to the reaction force from the striker 1 and thus may be pivotable in the clockwise direction in the figure.

Figure 3:
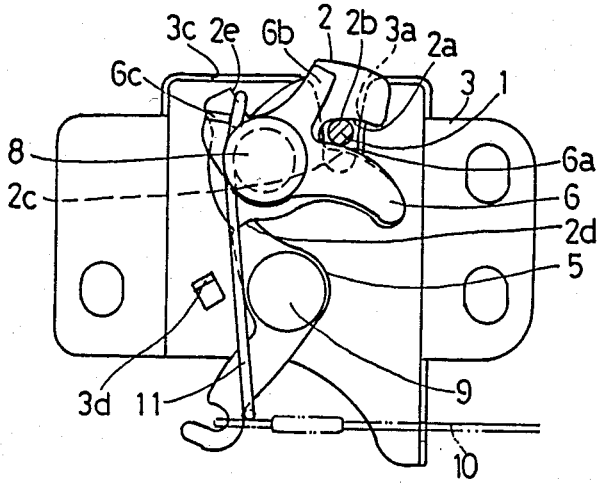
FIG. 3 is a front view of a second embodiment.
Figure 4:
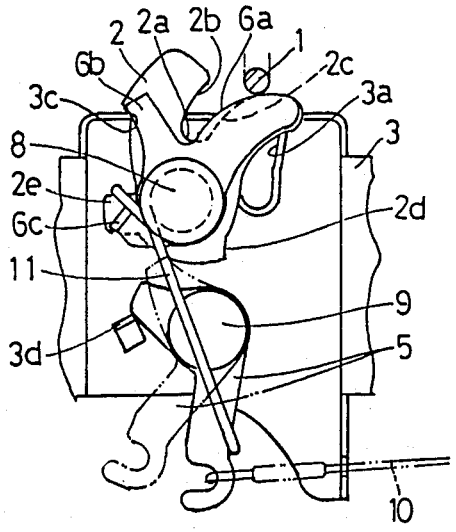
FIG. 4 is a view illustrating the operation thereof.

Now, the second embodiment of the present invention will be described with reference to FIGS. 3 and 4. This embodiment is identical to the above-mentioned embodiment in that it is provided with the jackplate 6 which is coaxial with and can be rotated separately from the locking plate or cam 2 and also with the engaging member 5 engaged with the cam section 2*d* of the cam 2, and differs in that it has one sole spring 11 mounted on the pivot 8 and one end of the spring being engaged with the projection 2*e* provided on the cam 2 and also with the projection 6*c* provided on the same side of the jackplate 6, and the other end being engaged with the engaging member 5. The projection 2*e* of the cam 2 and the projection 6*c* of the jackplate 6 may be engaged at their same location with one end of the spring 11, but in order not to concentrate the reaction forces they are engaged separately with the end of the spring and with the midway portion thereof. Other constructional details can be identical to those of the first embodiment so that the description is omitted by only providing them with similar reference numerals.

Also in the case of the second embodiment, when the engaging member or striker 1 enters the slot 2*a* of the cam 2 the spring force of the spring 11 is transmitted by the projection 6*c* to the jackplate 6 so as to rotate the jackplate 6 about the pivot 8 so that the slant edge 6*a* may move by a predetermined amount over the leading portion 2*c* of the cam 2 to press the striker 1. Therefore, the spacing constructionally required for the striker 1 and the slot 2*a* may be absorbed. When the opening and closing member is opened, the pivotal projection 6*b* may abut the abutting portion 3*c* so that no further rotation thereof may be made. This is the same with the case of the first embodiment.

What is claimed is:

1. A vehicle body having an opening defined by a surrounding frame, a closure for the opening, a locking device for the closure wherein the locking device comprises a striker on the closure, bracket means of the frame defining a striker slot for receiving the striker, a locking member rotatably mounted on the bracket means for rotation about a pivot axis adjacent the striker slot, the locking member having opposed tongue portions defining a locking slot therebetween, the locking member having a striker-receiving position wherein one of said tongue portions is disposed for engagement by the striker when entering the striker slot whereby movement of the striker into the slot is effective for rotating the locking member to bring the locking member into a locking position with the other of said tongue portions over the striker, an engaging member pivotally mounted on the bracket means, a cam portion on the locking member, an engagement portion on the engaging member for engaging with the cam portion when the locking member is in the locking position and preventing rotation of the locking member from the locking position to the striker-receiving position thereby preventing release of the striker until the engaging member is pivotally moved out of engagement with the locking member, a jack plate rotatably mounted on the bracket means about said pivot axis, the jack plate having a tongue substantially aligned with said one of said tongue portions of the locking member, and spring means biasing said tongue of the jack plate towards the other tongue portion of the locking member for engagement of the tongue with the striker when the locking member is in the locking position so as to take up play between the striker and the respective tongue portions of the locking member and reduce rattles in the locking device.

2. The invention as defined in claim 1 wherein the spring means comprises a spring having a first portion biasing the tongue of the jack plate as aforesaid and a second portion biasing the engaging member toward engagement with the locking member.

3. The invention as defined in claim 1 including further and separate spring means biasing the engaging member toward engagement with the locking member.

* * * * *